United States Patent [19]

Guinn

[11] 3,967,478

[45] July 6, 1976

[54] DOOR LATCHING APPARATUS ACTUATED BY CLEANSING AGENT SENSOR

[76] Inventor: Stanley G. Guinn, 1005 Crown Point Road W., Signal Mountain, Tenn. 37377

[22] Filed: June 9, 1975

[21] Appl. No.: 585,323

[52] U.S. Cl. ..... 70/144; 70/282; 204/195 R; 204/248; 324/29; 340/279

[51] Int. Cl.[2] ..... E05B 47/04

[58] Field of Search ..... 70/144, 277, 282, DIG. 46; 292/144, 201; 4/222; 136/83; 204/195 R, 248; 128/2, 12; 324/29; 340/279

[56] References Cited

UNITED STATES PATENTS

| | | | |
|---|---|---|---|
| 2,265,920 | 12/1941 | Maize | 324/65 R |
| 2,319,034 | 5/1943 | Bracke | 4/222 |
| 3,036,297 | 5/1962 | Simjian | 340/274 |
| 3,398,558 | 8/1968 | Benenati | 70/277 |

*Primary Examiner*—Paul R. Gilliam
*Attorney, Agent, or Firm*—Harrington A. Lackey

[57] ABSTRACT

An apparatus for unlatching a door to a hygienic area actuated by sensor electrodes in contact with the electrolytic residue of a cleansing agent upon the hand or limb of a person desiring access to the hygienic area.

5 Claims, 4 Drawing Figures

DOOR LATCHING APPARATUS ACTUATED BY CLEANSING AGENT SENSOR

BACKGROUND OF THE INVENTION

This invention relates to an apparatus for opening a door, and more particularly to an apparatus for unlatching a door in response to a cleansing agent activated sensor.

Heretofore, it is not believed that there have been any devices or systems for monitoring the cleanliness of the hands or arms of personnel engaged in the handling or processing of food, or engaged in other hygienic or sterile operations, except by direct observation of the personnel, or by reliance upon the integrity and responsibility of the personnel.

Although numerous systems of electrical circuitry have been designed for sensing various conditions and for actuating alarms or for controlling other mechanisms, nevertheless it is not believed that such a system has been designed for the latching and unlatching of a door functioning as an entry to a hygienic area by the sensing of an electrolytic residue of a cleansing agent upon the limb of personnel desiring to enter the hygienic area.

SUMMARY OF THE INVENTION

It is therefore an object of this invention to provide an apparatus for unlatching a locked door providing entry or access to a hygienic or sterile area by the actuation by an electrolytic sensor sensing the residue of a cleansing agent upon the hand or limb of the personnel desiring entry. The cleansing agent used by the personnel will not only be electrolytic, but will also possess the desired germicidal properties to render the hand or limb of the personnel sufficiently antiseptic to maintain the hygienic or sterile standards required of the personnel.

This apparatus includes an electromagnetic bolt and keeper assembly between a door and a door frame providing entry to the hygienic area. The electrical coil of the electromagnetic bolt assembly is connected to an electrical source of energy and to a switch device, preferably an SCR. The switch device is actuated, such as through the biasing lead to an SCR, by a pair of electrodes of dissimilar conductive materials which are mounted in spaced apart relationship in the vicinity of the door, so that the hand or limb of the personnel desiring entry can span and be in contact with both electrodes. The personnel desiring entry must have washed or cleansed his hands or arms or other limbs with the required germicidal cleansing agent, such as soap, which will normally leave a sufficient electrolytic residue on his hand to establish a current between the electrodes when the hand is placed in contact with both electrodes. The current established through the electrolytic residue and the electrodes will then actuate the switch device to close the circuit through the coil of the electromagnetic bolt mechanism for unlatching the door, thereby permitting entry to the hygienic area.

When the switch device is an SCR, a re-set switch must also be incorporated into the circuitry in order to open the circuit through the SCR after the door to the hygienic area is closed. In a preferred method, the re-set switch includes a pair of electrodes, one on the edge of the door and one on the door frame opposing and normally engaging the door electrode when the door is closed. Thus, after the door is unlatched and the door is pushed open, the electrical switch elements will disengage between the door and the door frame to open the circuit through the SCR and re-set the electrical circuit for the next door opening operation.

DESCRIPTION OF THE PREFERRED EMBODIMENTS

Figure 1:
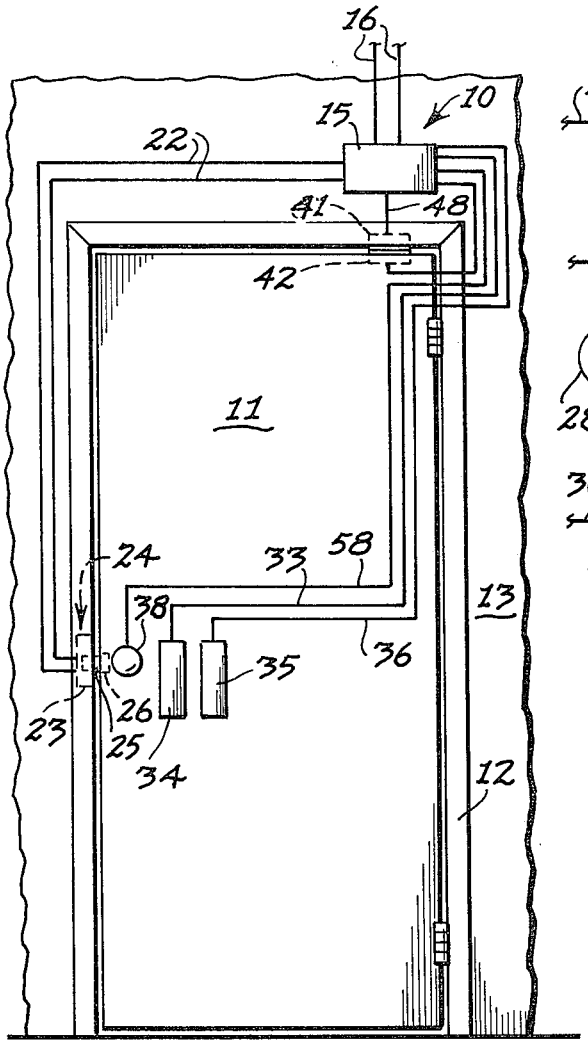
FIG. 1 is a front elevation of a door and door frame upon which the apparatus made in accordance with this invention has been installed, with the circuitry de-energized and the door latched.

Referring now to the drawings in more detail, FIG. 1 discloses the apparatus 10, made in accordance with this invention, installed upon a door 11 and a door frame 12 in a wall 13 separating a hygienic area behind the door 11, such as a food handling area, from the washing or scrubbing area on the proximate side or in front of the door 11.

The door opening or unlatching apparatus 10 includes the control mechanism within housing 15 supplied with electrical power, such as a household 110v. A.C. through power supply lines 16.

Figure 2:
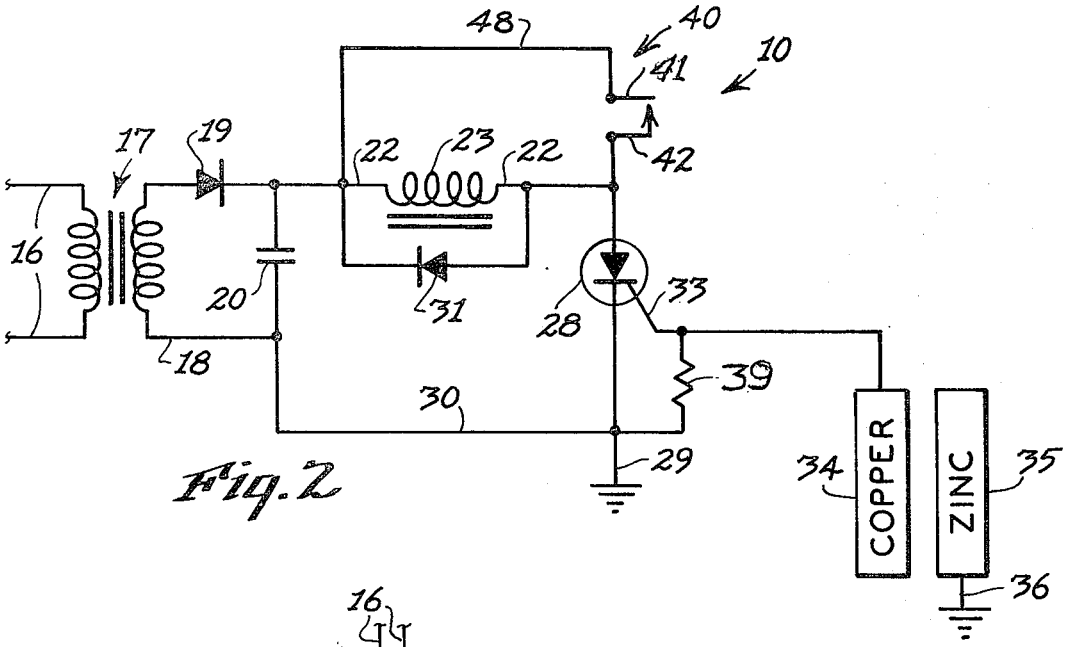
FIG. 2 is a schematic circuit diagram of the apparatus disclosed in FIG. 1.

Referring now to FIG. 2, the power lines 16 are connectd to a step-down transformer to reduce the voltage to 12v A.C. in the secondary circuit 18. The direct current voltage supply includes a filter diode 19 and a capacitor 20. The direct current is then transmitted through the lead 22 to the coil 23 of the electromagnetic bolt mechanism 24 including latch bolt 25. As disclosed in FIG. 1, the latch bolt 25 is in latched position projecting into a keeper 26 in the edge of the door 11. When the coil 23 is energized by electric current, the bolt 25 is retracted from the keeper 26 into the door frame 12 to permit the door 11 to be opened.

Referring back to FIG. 2, one end of the electromagnetic coil 23 is connected to the anode of an SCR 28, the cathode of which is connected to ground 29 and also through return line 30 to the other side of the secondary circuit 18 of the transformer 17.

The electromagnetic coil 23 is shunted by a diode 31.

The gate of the SCR 28 is connected through a gating lead or biasing lead 33 to a sensor electrode or plate 34, illustrated in the drawings as being made of copper. The electrode 34 is spaced from a second electrode 35 made of a dissimilar conductive material, such as zinc, which is grounded through lead 36. These electrode plates 34 and 35 may be mounted anywhere in the vicinity of the door 11 in the washing or scrubbing area in front of the door 11. As disclosed in FIG. 1, both electrode plates 34 and 35 are mounted spaced apart parallel to each other upon the door 11 adjacent the door knob 38.

The gating lead 33 is connected to the cathode of the SCR 28 through the resistor 39.

The re-set switch device 40 may have a variety of forms, but is disclosed in the drawings as an electrical contact element 41 mounted in the door frame 12 and an electrical contact element 42 mounted in the door 11 opposing and normally in electrical contact with the element 41 when the door 11 is closed. As disclosed in FIG. 2, the contact element 42 is connected in parallel with the electromagnetic coil 23 and in series with the SCR 28. The contact element 41 is connected through lead 48 to the secondary circuit 18.

Figure 3:
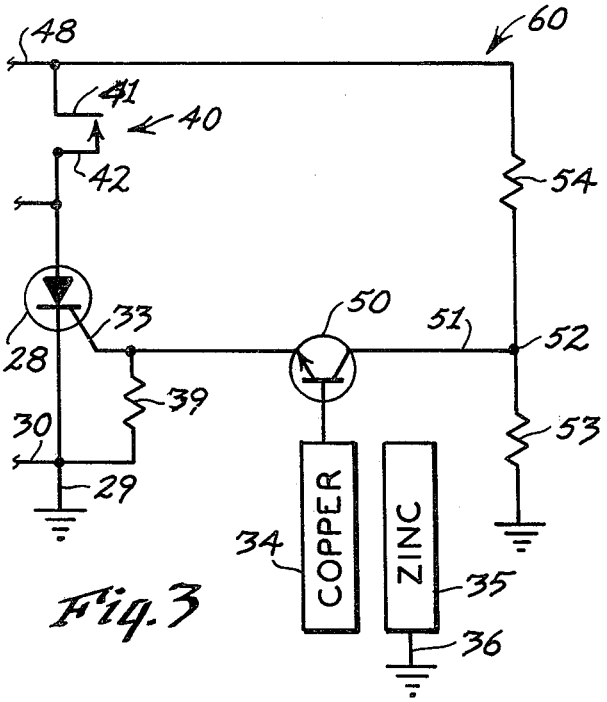
FIG. 3 is a partial schematic view of a modified electrical circuit.

The circuitry of FIG. 3 is the same as the circuitry of FIG. 2 with the exception that the gating lead 33 of the SCR 28 is connected to the electrode 34 through the emitter and base of a transistor 50. The collector of the transistor 50 is connected through collector lead 51 to junction 52, which in turn is connected through lead resistor 53 to ground. The junction 52 is also connected through a resistor 54 to the shunt circuit 48.

The purpose of the modified circuit 60 in FIG. 23, including the transistor 50, is to obtain more gain for the SCR 28 by amplifying a weak electrolytic circuit across the electrodes 34 and 35 through the transistor 50.

In the operation of the apparatus 10, the door 11 would normally be closed with the latch bolt 24 thrown in its locked, de-energized position. With the door 11 closed, the contacts 41 and 42 engage each other.

Before entering a food handling area on the remote or backside of the wall 13 through the door 11, a person, such as a food handler, would normally wash his hands with the soap or cleansing agent with the desired germicidal and electrolytic properties in a washing area in front of the door 11. After the food handler completes the washing of his hands, then, even if he dries his hand with a warm air blower or towel, a sufficient amount of the electrolytic soap residue will remain on his hands to active the sensors 34 and 35. The person then approaches the door and places his hand carrying the electrolytic residue across the electrode plates 34 and 35 so that a solid physical and electrical contact is made between the surface of the hand and both electrode plates 34 and 35. A weak current will then be transmitted across the electrode plates 34 and 35 and through the electrolytic residue of the cleansing agent or soap upon the person's hand. This current is then conducted through the gating lead 33 to bias the SCR 28 into conduction, thereby closing the circuit through the secondary of the transformer 17, the electromagnetic coil 23 and the SCR 28. Energization of the coil 23 will then retract the latch bolt 25 from the keeper 26 to clear the door 11 and permit it to be opened. The food handler will then grasp the door knob 38, open the door 11 and enter through the door frame 12 into the food handling area. As the door 11 swings open, the switch elements 41 and 42 will break contact to open the circuit through the SCR 28 thereby switching the SCR 28 into non-conduction, where it will remain until the next detection of a clean hand by the sensing electrodes 34 and 35.

Figure 4:
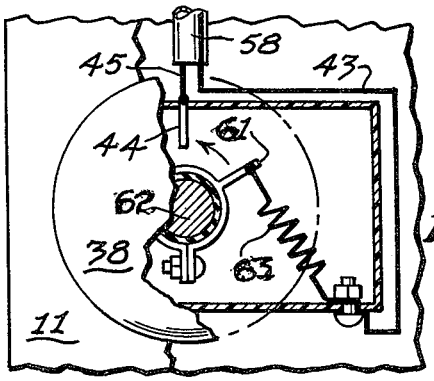
FIG. 4 is an enlarged, fragmentary, front elevation, partially broken away, of the door knob and alarm switch.

As illustrated in FIGS. 1 and 4, a switch may be controlled by the door knob 38 and connected through electrical cable 58 to the control box 15 to set off an alarm or indicator, not shown, should the person attempt to open the door 11 without registering his hand with the electrode plates 34 or 35, or should his hands not be clean enough or have a sufficient amount of electrolytic residue on them to energize the SCR 28. The specific alarm switch disclosed in FIG. 4 includes a rotary switch element 61 mounted on door knob shaft 62 and held in a normally open, inoperative position by conductive spring 63. The conductive spring 63 is connected to lead 43 which is part of cable 58. When the door knob 38 is turned to open the door, rotary switch element 61 engages stationary switch element 44 connected to cable lead 45 to close the switch and energize the alarm or indicator, if the bolt 25 is still closed in locked position.

Mechanical overriding circuits (not shown) may be provided to prevent a person from becoming permanently locked in or detained for an excessive amount of time within the area secured by the door 11. The override circuits could be attached to certain alarms or indicators, such as bells or lights to alert supervisory personnel that employees are leaving the washing area or bathroom without washing their hands.

What is claimed is:

1. An apparatus for latching and unlatching a door in a door frame, comprising:

a. an electromagnetic bolt mechanism adapted to latch said door to said door frame when said bolt mechanism, is de-energized and to unlatch said door from said door frame when said bolt mechanism is energized, b. an electrical energy source for said electromagnetic bolt mechanism, c. a pair of electrolytically dissimilar electrodes mounted in the vicinity of said door, d. said electrodes being spaced apart a distance no greater than the length of the portion of a human limb coated with the electrolytic residue of a cleansing agent spanning and in contact with both said electrodes, whereby an electric current may be established between said electrodes and through said electrolytic residue, e. electrical switch means connected to said electromagnetic bolt mechanism and to said energy source, and, f. means for actuating said switch means to energize said bolt mechanism, when an electric current is established across said electrodes.

2. The invention according to claim 1 in which said switch means and said actuating means comprises an electrical gate switch in series with said electrical energy source and the electrical coil of said electromagnetic bolt mechanism, a gating lead connecting one of said electrodes to said gating switch, whereby a current crossing said electrodes and through said gating lead will bias said gate switch device into conduction for energizing the electrical coil of said electromagnetic bolt mechanism.

3. The invention according to claim 2 in which said gate switch comprises an SCR, and further comprising a re-set switch device adapted to open the series circuit containing said electrical source, said electrical coil and said SCR, upon actuation.

4. The invention according to claim 3 in which said re-set switch device comprises a pair of switch elements, one on said door and one on said door frame, normally engaging each other when said door is closed within said door frame, and adapted to be separated by the opening of said door, whereby said re-set switch device is actuated when said door is closed and deactuated when said door is open.

5. The invention according to claim 1 in which said dissimilar electrodes comprise a pair of plates of dissimilar conductive materials mounted on said door.

* * * * *